US006421864B2

(12) United States Patent
Daiguji et al.

(10) Patent No.: US 6,421,864 B2
(45) **Date of Patent: *Jul. 23, 2002**

(54) BRIDGE CABLE FIXING STRUCTURE

(75) Inventors: Hisashi Daiguji; Makoto Tomimoto, both of Kanagawa-ken; Tsutomu Kadotani, Atsugi, all of (JP)

(73) Assignee: Fanuc LTD, Oshino-mura (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/366,705

(22) Filed: Aug. 2, 1999

(51) Int. Cl.[7] ..... E01D 11/00; E04C 5/08
(52) U.S. Cl. ..... 14/21; 14/22; 52/223.13
(58) Field of Search ..... 14/21, 22; 52/223.1, 52/223.13

(56) References Cited

U.S. PATENT DOCUMENTS 3,060,639 A * 10/1962 Fields et al.
3,647,184 A * 3/1972 Vanderhurst et al. ..... 254/29 A
3,658,296 A * 4/1972 Yegge ..... 254/29 A
3,701,509 A * 10/1972 Stinton ..... 254/29 A
3,778,869 A * 12/1973 Andrews ..... 24/115 R
3,820,832 A * 6/1974 Brandestini et al.
4,557,007 A * 12/1985 Daiguji et al. ..... 14/22
5,469,677 A * 11/1995 Luthi ..... 52/223.13
5,809,710 A * 9/1998 Jungwirth et al. ..... 52/223.1

FOREIGN PATENT DOCUMENTS

JP 5412512 9/1979
JP 1-219203 * 9/1989 ..... 14/22

* cited by examiner

*Primary Examiner*—Gary S. Hartmann
(74) *Attorney, Agent, or Firm*—Greenblum & Bernstein P.L.C.

(57) ABSTRACT

A bridge cable fixing structure, including a fixing plate having multiple cylindrical insertion holes and cylindrical fixing grips corresponding to the insertion holes, each fixing grip being attached to an end of a twisted steel wire. The fixing grips are positioned in the insertion holes on a compression side of the fixing structure, such that the twisted steel wires extend from a tensile side of the fixing structure. When a load is applied to the twisted steel wires attached to the fixing grips, the fixing plate deforms toward the tensile side, compressing the insertion holes against the fixing grips.

14 Claims, 4 Drawing Sheets

BRIDGE CABLE FIXING STRUCTURE

BACKGROUND OF THE INVENTION

1. Field of the Invention

This invention relates to a structure for fixing a terminal end of a cable for supporting a bridge beam of a skew bridge or a cable for supporting a hanging structure, and more particularly, an improvement about a press fixing grip system in which a press fixing grip is fixed to a terminal end of the PC steel twisted wire constituting a cable and the press fixing grip is engaged with and fixed to a fixing plate fixed to an inner side of an anchor socket.

2. Description of the Related Art

Cables 3 for supporting a bridge beam 11 in the skew bridge shown in FIG. 1 are made such that a desired number of bundles of the PC steel twisted wires are bundled and as a system employed for fixing the terminal ends of the wires nowadays, there is provided a press fixing grip system.

The press fixing grip system is constructed such that a fixing plate 2' is fixed inside the anchor socket 1' as shown in FIG. 8 and the end part of the press fixing grip 5' fixed to an outer side of the terminal end of each of the PC steel twisted wires 4' is engaged with an edge of each of insertion holes passed through and opened at the fixing plate 2' and then fixed. Then, the PC steel twisted wires inserted into and passed through the fixing plate except the central part thereof are inclined in a slant manner and fixed in such a way that they may be dispersed from the central part toward an outside part in a radial direction.

The aforesaid related art structure is a structure in which a tensile load of the cable is supported by the fixing plate and a press fixing grip press fixed and fixed to an outside part of a terminal end of the PC steel twisted wire and further epoxy resin (APS compound) 8 is fed into a space between the press fixing grips arranged outside the fixing plate to endure against a varying stress caused by an active load.

Accordingly, in this case, the fixing part capable of being endured against a tensile load is defined as a fixing part having a range extending up to the end part of the press fixing grip engaged with the fixing plate, resulting in that a thickness T' at the fixing part is formed thick.

In addition, since the bundled PC steel twisted wires are fixed in an inclined state in such a way that the press fixing grips are dispersed in a radial direction, a center at an inlet side of the insertion hole and a center at an outlet side of the insertion hole opened at the fixing plate are displaced and then a diameter L' of the fixing plate is also set to be large.

If a thickness and a diameter of the fixing plate are set to be large, it is naturally required to provide a large-sized anchor socket having the fixing plate installed therein and their sizes may influence against its handling work at site.

This invention has been invented in reference to the problem of the related art described above and it is an object of the present invention to provide a bridge cable fixing structure in which an outer diameter and a thickness of a fixing plate for accepting a tensile load of the cable can be reduced and a size of the anchor socket can be decreased.

SUMMARY OF THE INVENTION

A technical means applied by the present invention in order to solve the aforesaid problem consists in a bridge cable fixing structure in which some press fixing grips are fixed to terminal ends of PC steel twisted wires and the side ends of the press fixing grips are engaged with the fixing plate inside an anchor socket, wherein insertion holes of about same diameter into which PC steel twisted wires are inserted are opened at one side of said fixing plate and the press fixing grip engaging holes to which the outer circumferential surfaces of the press fixing grips are closely contacted on axis lines of said insertion holes are communicated with and opened at the other side of said fixing plate, and the side ends and the outer circumferential surfaces of the press fixing grips are closely contacted to and engaged with the fixing plate.

A large number of insertion holes (fixing grip engaging holes on co-axial lines) opened at the fixing plate are arranged such that their axes are set in parallel with a center of the fixing plate and equally spaced apart around the fixing plate in a radial direction.

In addition, the press fixing grip engaging holes at the fixing plate are opened at least a half of or more than half of the thickness of the fixing plate.

Further, the aforesaid fixing plate may be applied as either a separate structure which is separate from the anchor socket or an integral structure which is integral with the socket.

In accordance with the aforesaid means, if the circumferential edge at the side part of the fixing plate where the insertion holes are opened is supported by the anchor socket and a tensile load is applied to the cables, one side where the insertion holes are formed is applied as a tensile side and the other side where the fixing grip engaging holes at the opposite side are opened is applied as a compression side with a center of the thickness of the fixing plate (a neutral axis) being applied as an interface. Then, the fixing grips inserted into the fixing grip engaging holes formed at the compression side are pushed with the hole circumferential wall surfaces of the fixing grip engaging holes so as to prevent the fixing grips from being pulled out of the PC steel twisted wires and their diameters from being expanded (bulged out). With such an arrangement as above, the fixing grips are integrally assembled with the fixing plate.

Accordingly, it can be considered that some fixing grips arranged and fixed to the compression side of the fixing plate have effective sectional area, thereby it becomes possible that a lost amount of section caused by opening the fixing grip engaging holes is restricted to a minimum amount and a thickness of the fixing plate can be made thin as compared with that of the related art structure.

Further, the fixing grips can be integrally assembled with the fixing plate under the aforesaid configuration and each of the insertion holes is opened in parallel with the center of the fixing plate, resulting in that a diameter of the fixing plate can be made small as compared with that of the related art structure.

DESCRIPTION OF THE PREFERRED EMBODIMENTS

Figure 1:
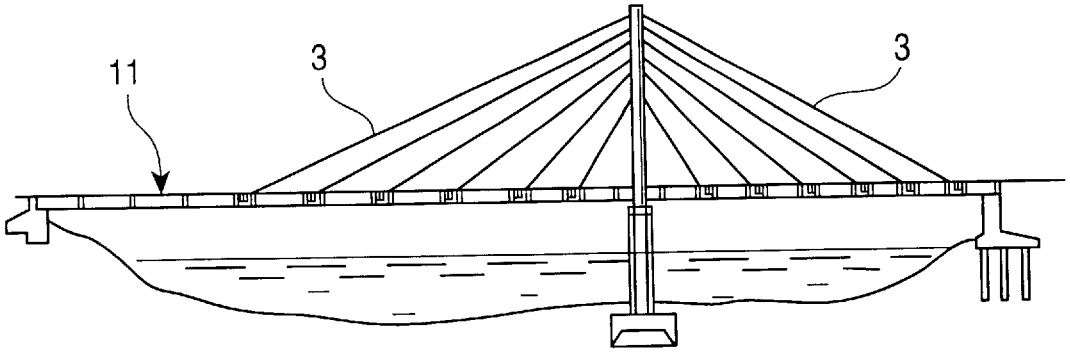
FIG. 1 is a front elevational view for showing one example of a bridge structure.

Referring now to the drawings, some preferred embodiments of the present invention will be described as follows.

Figure 2:
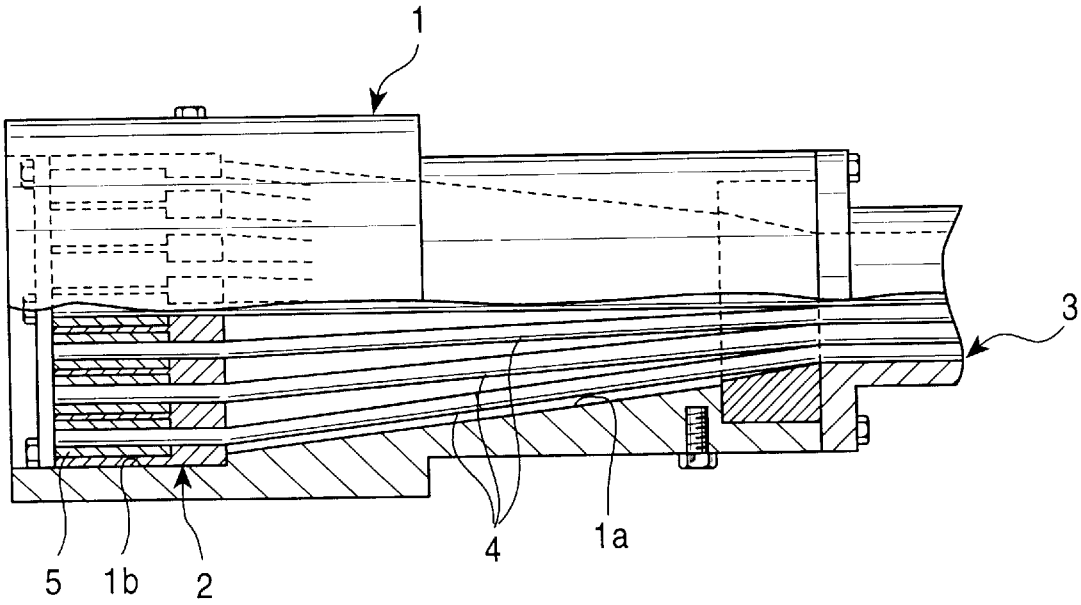
FIG. 2 is a front elevational view with a part being broken away for showing one preferred embodiment of the present invention.

FIG. 2 shows a structure in which a fixing plate is fixed to an anchor socket and some PC steel twisted wires are fixed to the fixing plate, as shown in drawing, wherein reference numeral 1 denotes an anchor socket, its outer shape is constituted to have a stepped cylindrical shape, its inner side is formed with a tapered hole 1*a* and a linear cylindrical hole 1*b* continuous with its large diameter side, a disc-shaped fixing plate 2 is fitted to and fixed to the linear cylindrical hole 1*b* and then cables 3 having some PC steel twisted wires bundled in parallel from each other are engaged with and fixed to the fixing plate 2.

Engaging and fixing of some cables 3 against the fixing plate 2 are carried out such that a press fixing grip 5 is pressed and fixed to an outside part of a terminal end of each of the PC steel twisted wires 4 constituting the cables 3, each of the press fixing grips 5 is engaged with and integrally formed with the fixing plate 2.

Figure 3:
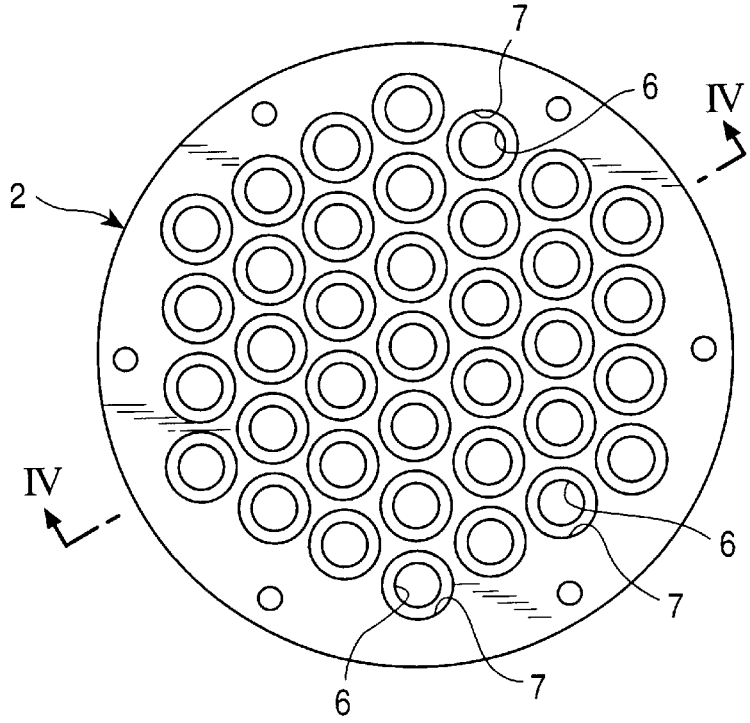
FIG. 3 is an enlarged side elevational view for showing a fixing plate (section).
Figure 4:
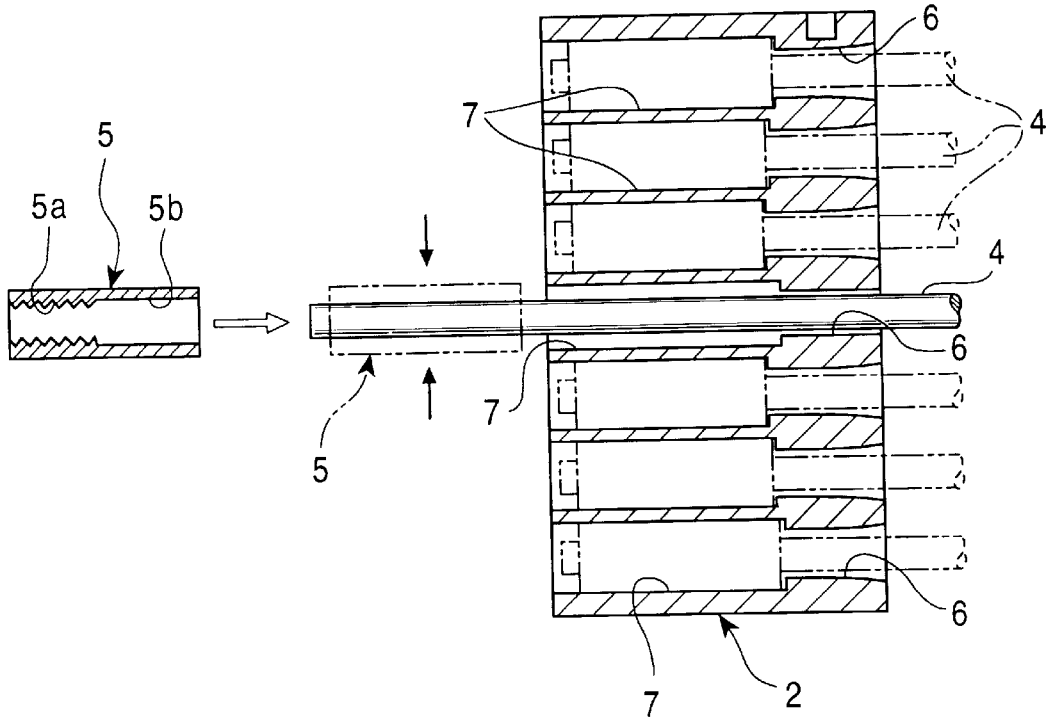
FIG. 4 is a sectional view taken along a line (4)—(4) of FIG. 3.

As shown in FIGS. 3 and 4, the aforesaid fixing plate 2 is a disc having a predetermined thickness, wherein insertion holes 6 having a substantial same diameter as an outer diameter of each of the PC steel twisted wires 4 constituting the cables 3 are opened or formed in parallel with a center of the fixing plate 2 at one side thereof (a tensile side), the other side of the fixing plate 2 (a compression side) is formed with press fixing grip engaging hole 7 positioned on an axial line of the insertion hole 6 and having a substantial same diameter as an outer diameter of the press fixing grip 5 press fitted to a terminal end of the PC steel twisted wire 4, and, a depth (a length) of the press fixing grip engaging hole 7 is at least a half of or more than half of thickness of the fixing plate 2, and the insertion hole 6 and the press fixing grip engaging hole 7 are opened to be communicated to each other.

The press fixing grip 5 to be pressed and fixed to an outside part of the terminal end of the PC steel twisted wire 4 may be a well-known one having a smooth inner surface, although it may also be applicable that a thread 5*a* is threadably formed at an inner surface of about half length of an entire length of the grip as shown in FIG. 4, sintered and the remaining half of it is formed with a smooth flat surface 5*b* as found in the related art. This press fixing grip 5 can be adapted for a pulling action of high tension force (a tensile load) at the section where the thread 5*a* is formed and it can be sufficiently applied to the galvanized PC steel twisted wires of which slip was confirmed in the related art press fixing grip. Then, within a range of designed load, a strength can be assured at the smooth flat cylinder part, an influence of the pressing against the PC steel twisted wires can be restricted as much as possible, an influence against a fatigue strength can be reduced and a strength can be assured at the flat smooth cylinder part, resulting in that a transfer of stress toward the threaded cylinder can be reduced.

In the method for pressing and fixing the press fixing grip 5 against the outside part of the terminal end of the PC steel twisted wire 4, a pressing and fitting machine provided with a hydraulic cylinder is applied.

The pressing and fitting machine is operated such that the PC steel twisted wire is inserted into a center of die, the press fixing grip is fixed and installed to the PC steel twisted wire passed through the die, an axial end of the press fixing grip is pushed into the die with a head connected to and fixed to a piston rod of the hydraulic cylinder through a pushing rod, thereby an outer diameter of the press fixing grip is metered with an inner diameter of the die and fastened, thereby the press fixing grip is integrally press fitted and fixed to the outside part of the PC steel twisted wire.

In this case, in order to cause an outer diameter (a diameter) of the press fixing grip after its press fixing to be smaller than that of the related art, the material having a higher strength than that of the related art press fixing grip was used. Along with this application, a length of a linear line part (a parallel part) of the minimum diameter part was changed to be longer (by more than 10 mm) than that of the minimum diameter part of the die in the related art. With such an arrangement as above, after the press fixing grip is press fixed, it is possible to prevent the press fixing grip from being curved.

Accordingly, it is possible to constitute the press fixing grip to be fixed and engaged positively to the press fixing grip engaging hole 7 of the fixing plate 2.

Then, referring to FIGS. 5 and 6, a relation between the aforesaid fixing plate 2 and the press fixing grip 5 for the PC steel twisted wires 4 will be described. For a sake of convenience in understanding of the present invention, the drawings illustrate one clearance between the anchor socket 1 and the fixing plate 2 and the other clearance between the fixing plate 2 and the press fixing grip 5, although actually each of the members is closely contacted from each other.

Figure 5:
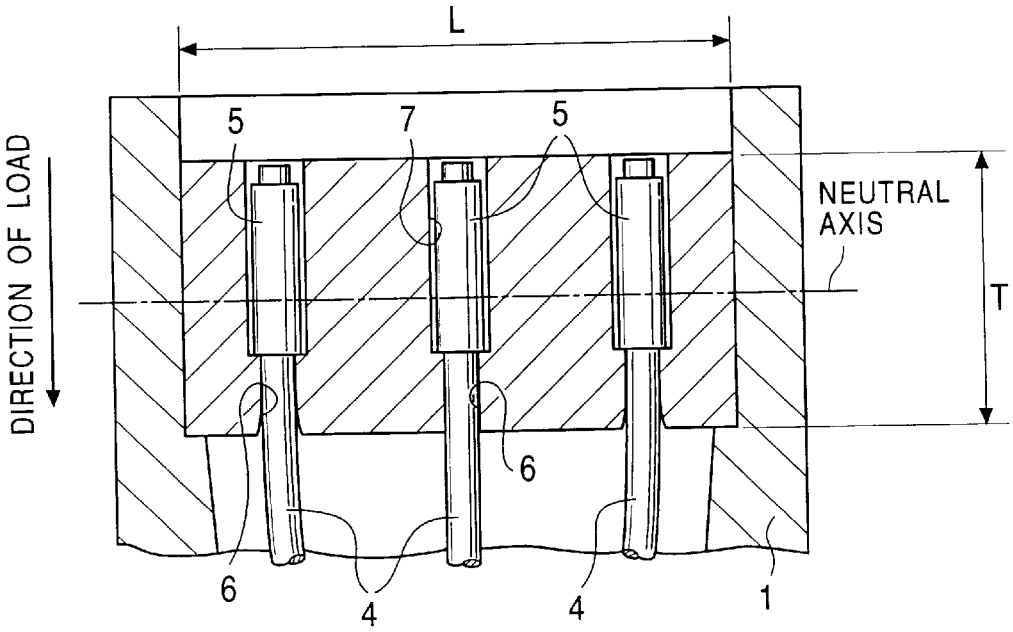
FIG. 5 is an illustrative view for showing a relation between a fixing plate and a press fixing grip.
Figure 6:
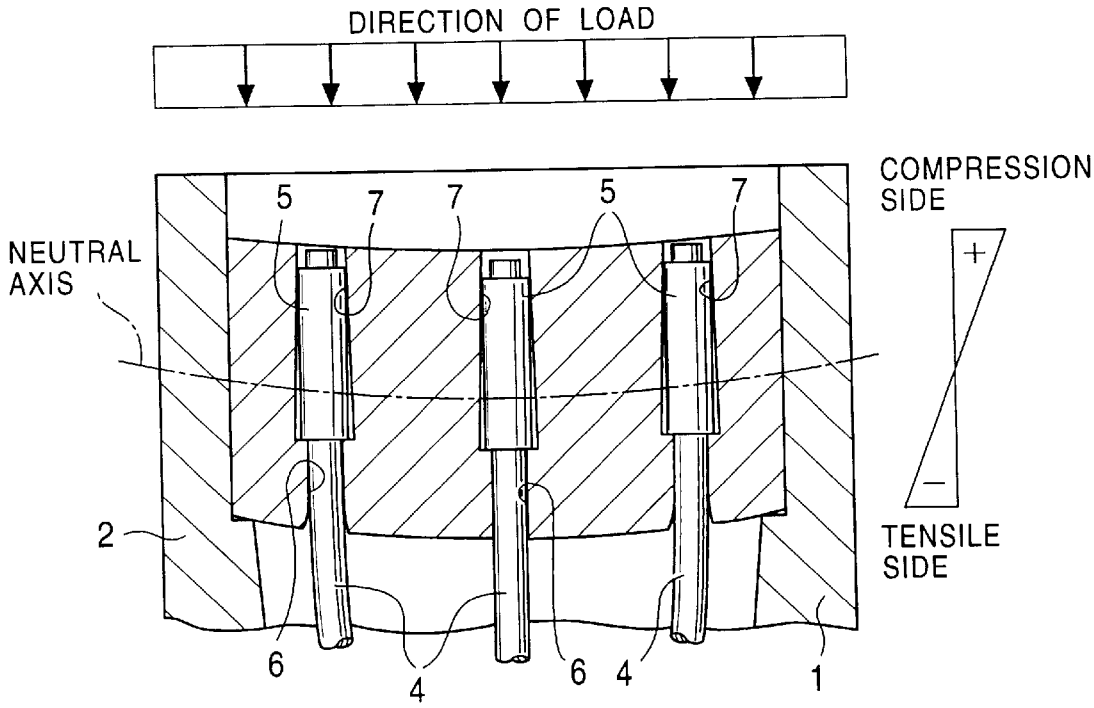
FIG. 6 is an illustration for showing a deformation of a fixing plate (a fixing section) when a tensile force is applied to it.
Figure 8:
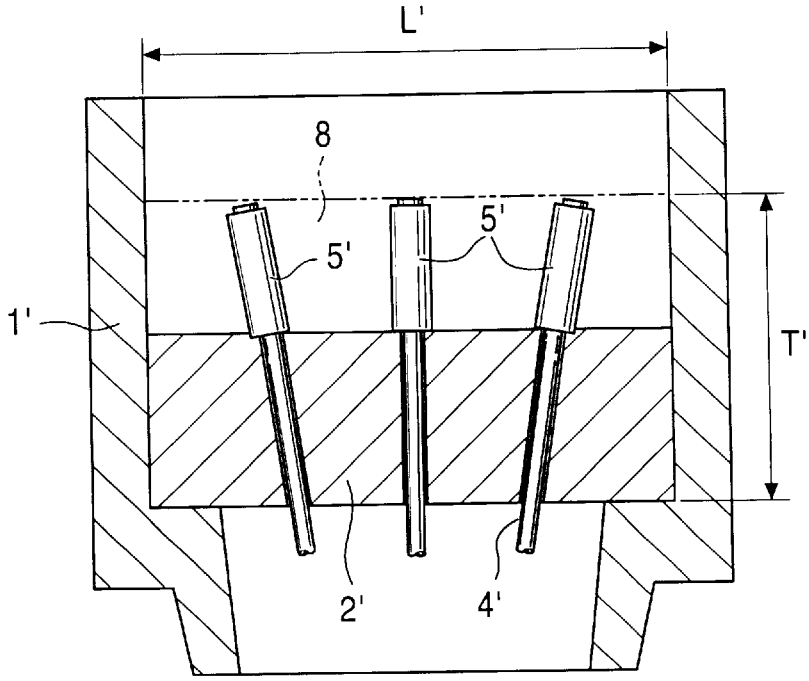
FIG. 8 PRIOR ART
FIG. 8 is a sectional view for showing the structure of the related art.

FIG. 5 shows a state in which the fixing plate 2 is fitted to and fixed to the linear cylindrical hole 1*b* of the anchor socket 1, the PC steel twisted wires 4 are inserted into the insertion holes 6 of the fixing plate 2 and the press fixing grips 5 fixed to the outside parts of the terminal ends of the PC steel twisted wires 4 are fixed and closely contacted with the press fixing grip engaging holes 7. Under this state, when a tensile force is acted in a direction of load, the fixing plate 2 is supported by the anchor socket 1 at its outer circumferential edge, deformed as shown in the drawing, an opening side of the insertion hole 6 becomes a tensile side and an opening side of the press fixing grip engaging hole 7 becomes a compression side, the press fixing grips 5 positioned at the compression side rather than a neutral axis are integrally formed while their outer circumferential surfaces are being closely contacted with the circumferential wall surfaces of the press fixing grip engaging holes 7, resulting in that the press fixing grip part can be assumed to have an effective sectional area, thereby a loss of the sectional surface at the press fixing grip engaging holes 7 opened at the fixing plate 2 can be restricted to a minimum value and a thickness T of the fixing plate 2 can be made thin as compared with that of the related art product (refer to FIG. 8).

That is, when the aforesaid fixing plate 2 is deformed, a compression force in a direction of diameter is acted upon the circumferential wall of the press fixing grip engaging hole 7 to which the press fixing grip 5 is fixed so as to restrict the press fixing grip against its expanding in its diameter (bulged out) and then the press fixing grip and the fixing plate 2 are integrally assembled.

Then, an effect caused by reducing a thickness T and a diameter L of the aforesaid fixing plate 2 is made such that as compared with that of our related art (for example, in the case of the cable comprised of 37 PC steel twisted wires), the thickness T was reduced by about 20% and the diameter L was also reduced by about 20%, along with these reductions, an outer diameter of the anchor socket was also reduced by about 20% and its conversion into weight showed a reduction of about 30%.

Although the aforesaid preferred embodiment of the present invention has been described in reference to the preferred embodiment in which the fixing plate 2 is separate from the anchor socket 1, the fixing plate may be integrally formed with the socket.

Figure 7:
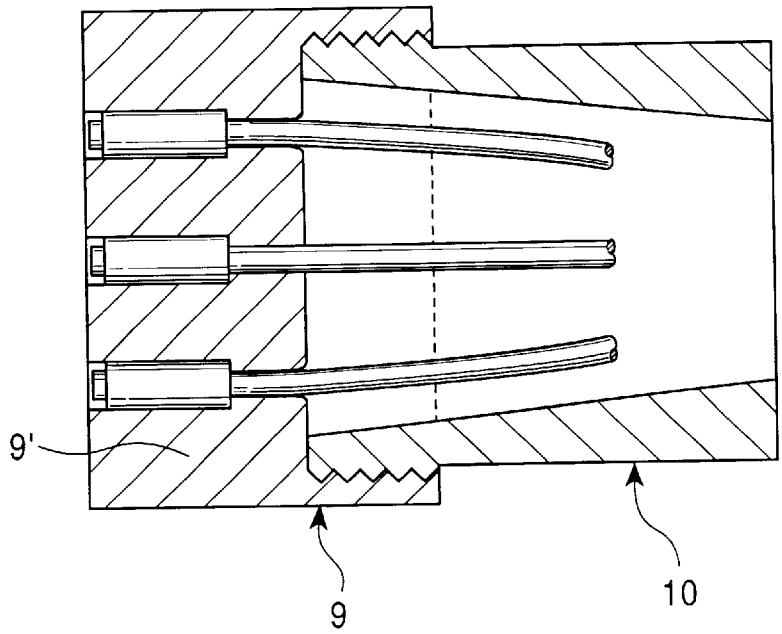
FIG. 7 is a schematic view for showing another preferred embodiment of a fixing structure of the present invention.

Its constitution will be described in brief as follows, wherein as shown in the schematic figure of FIG. 7, a fixing plate 9' is integrally formed with a fixing part 9 and then a fatigue improving socket 10 is connected to and integrally assembled with the fixing part 9 through a threaded structure. Arrangement of the structure shown in FIG. 7 enables a manufacturing cost to be reduced and its manufacturing property to be improved.

The fixing structure for the bridge cable of the present invention is made such that the press fixing grip and the fixing plate can be integrally assembled, thereby a thickness of the fixing part as well as its diameter can be reduced by about 20% as compared with those of the related art structure, and its converted weight can be reduced by about 30%.

Accordingly, a handling of the product in working at construction site may be facilitated and its workability can be improved.

Having described specific examples of the invention with reference to the accompanying drawings, it will be appreciated that the present invention is not limited to those precise embodiments, and that various changes and modifications can be effected therein by one of ordinary skill in the art without departing from the scope of the invention as defined by the appended claims.

What is claimed is:

1. A bridge cable fixing structure comprising:

an anchor socket;

a fixing plate engaged within said anchor socket, said fixing plate comprising a tensile side and a compression side and defining a plurality of insertion holes; and a plurality of fixing grips, each fixing grip being attached to an end of a twisted wire and disposed within a corresponding one of said plurality of insertion holes such that the twisted wire attached to each fixing grip projects from the tensile side of said fixing plate;

wherein an outer surface of each of said fixing grips is mechanically engaged with an inner surface of a corresponding insertion hole; and wherein said fixing plate deforms toward the tensile side when a load is applied to the twisted wire attached to each fixing grip, compressing the inner surface of each of said plurality of insertion holes against the outer surface the corresponding fixing grip at the compression side of said fixing plate.

2. The bridge cable fixing structure according to claim 1, wherein each of said plurality of fixing grips and the corresponding one of said plurality of insertion holes are cylindrical.

3. The bridge cable fixing structure according to claim 2, wherein each of said plurality of insertion holes comprises an engaging hole portion opening on the compression side of said fixing plate and an insertion hole portion opening on the tensile side of said fixing plate, said engaging hole portion and said insertion hole portion being axially aligned, and said engaging hole portion having a diameter larger than a diameter of said insertion hole portion, and forming a circumferential lip at a juncture of said engaging hole portion and said insertion hole portion;

wherein an outer diameter of each of said plurality of fixing grips is approximately equal to an inner diameter of said engaging hole portion of the corresponding one of said plurality of insertion holes; and wherein each of said plurality of fixing grips is mechanically engaged with the circumferential lip at the juncture of the engaging hole portion and the insertion hole portion of the corresponding one of said plurality of insertion holes holding each of said plurality of fixing grips within the corresponding one of said plurality of through-holes when a load is applied to the twisted wire.

4. The bridge cable fixing structure according to claim 3, wherein the engaging hole portion of each of said plurality of insertion holes extends through more than half of a thickness of said fixing plate.

5. The bridge cable fixing structure according to claim 1, said anchor socket having a shoulder between a large section and a small section, said fixing abutting against said shoulder to be maintained in position within said anchor socket.

6. The bridge cable fixing structure according to claim 1, said anchor socket comprising a fixing section and a socket section, said fixing section and said socket section being coupled to each other by cooperating threaded sections on each of said fixing section and said socket section, said fixing plate being integral with said fixing section.

7. The bridge cable fixing structure according to claim 1, wherein each of said fixing grips is provided with a thread on at least a portion of an inner surface.

8. The bridge cable fixing structure according to claim 7, wherein the circumferentially threaded portion extends at least one half of a length of each of said plurality of fixing grips.

9. The bridge cable fixing structure according to claim 8, wherein an inner surface of each of said plurality of fixing grips comprises a circumferentially threaded portion, the circumferentially threaded portion engaging the twisted wire.

10. A bridge cable fixing structure comprising:

an anchor socket;

a fixing plate engaged within said anchor socket, said fixing plate comprising a tensile side and a compression side and defining a plurality of cylindrical through-holes, each of said plurality of cylindrical through-holes comprising an engaging hole portion opening on the compression side of said fixing plate and an insertion hole portion opening on the tensile side of said fixing plate, said engaging hole portion and said insertion hole portion being axially aligned, and said engaging hole portion having a diameter larger than a diameter of said insertion hole portion, forming a circumferential lip at a juncture of said engaging hole portion and said insertion hole portion; and a plurality of cylindrical fixing grips, each fixing grip being attached to an end of a twisted wire and disposed within a corresponding one of said plurality of through-holes, said fixing grip being positioned within said engaging hole portion and the twisted wire extending through said insertion hole portion;

wherein an outer diameter of each of said plurality of fixing grips is approximately equal to an inner diameter of said engaging hole portion of the corresponding one of said plurality of through-holes; and wherein each of said plurality of fixing grips is mechanically engaged with the circumferential lip at the juncture of the engaging hole portion and the insertion hole portion of the corresponding one of said plurality of through-holes, holding each of said plurality of fixing grips within the corresponding one of said plurality of through-holes when a load is applied to the twisted wire; and wherein said fixing plate deforms toward the tensile side when a load is applied to the twisted wire attached to each fixing grip, compressing the inner surface of said insertion portion of each of said plurality of through-holes against the outer surface the corresponding fixing grip at the compression side of said fixing plate.

11. The bridge cable being fixing structure according to claim 8, wherein said plurality of cylindrical through-holes are parallel to one another.

12. The bridge cable fixing structure according to claim 8, said anchor socket having a shoulder, between a large section and a small section, said fixing plate being abutted against said shoulder to be maintained in position within said anchor socket.

13. The bridge cable fixing structure according to claim 8, said anchor socket comprising a fixing section and a socket section, said fixing section and said socket section being coupled to each other by cooperating threaded sections on each of said fixing section and said socket section, said fixing plate being integral with said fixing section.

14. The bridge cable fixing structure according to claim 8, wherein each of said fixing grips is provided with a thread on at least a portion of an inner surface.

* * * * *

UNITED STATES PATENT AND TRADEMARK OFFICE

CERTIFICATE OF CORRECTION

PATENT NO. : 6,421,864 B2
DATED : July 23, 2002
INVENTOR(S) : H. Daiguji et al.

It is certified that error appears in the above-identified patent and that said Letters Patent is hereby corrected as shown below:

Title page,
Item [73], Assignee, delete "Fanuc LTD, Oshino-mura (JP)".

Signed and Sealed this

Fourth Day of February, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,421,864 B2
DATED : July 23, 2002
INVENTOR(S) : H. Daiguji et al.

It is certified that error appears in the above-identified patent and that said Letters Patent is hereby corrected as shown below:

Title page,
Item [56], References Cited, FOREIGN PATENT DOCUMENTS,
"5412512" should be -- 54121512 --.

Column 6,
Line 22, after "fixing" insert -- plate --.
Line 37, "claim 8" should be -- claim 10 --.

Column 7,
Line 15, after "cable" delete "being".
Line 16, "claim 8" should be -- claim 10 --.

Column 8,
Lines 1 and 16, "claim 8" should be -- claim 10 --.

Signed and Sealed this

Thirteenth Day of May, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,421,864 B2
DATED : July 23, 2002
INVENTOR(S) : H. Daiguji et al.

It is certified that error appears in the above-identified patent and that said Letters Patent is hereby corrected as shown below:

Title page,
Item [73], Assignee, delete "Fanuc LTD, Oshino-mura (JP)".

The Certificate of Correction issued February 4, 2003 should be vacated since Certificate of Correction was not granted.

Signed and Sealed this

Seventeenth Day of February, 2004

JON W. DUDAS
*Acting Director of the United States Patent and Trademark Office*